US008215623B2

(12) United States Patent
Bradsher

(10) Patent No.: US 8,215,623 B2
(45) Date of Patent: Jul. 10, 2012

(54) PANELS-OFF COATING PROCESS AND CARRIER UTILIZING PANEL ROTATION

(75) Inventor: Jeffrey W. Bradsher, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 983 days.

(21) Appl. No.: 12/108,755

(22) Filed: Apr. 24, 2008

(65) Prior Publication Data

US 2009/0269170 A1 Oct. 29, 2009

(51) Int. Cl.
*B25B 1/20* (2006.01)

(52) U.S. Cl. ..... 269/37; 269/55; 269/71

(58) Field of Classification Search ..... 269/37, 269/900, 55, 6, 71, 136–139; 29/281.1, 281.3
See application file for complete search history.

(56) References Cited

U.S. PATENT DOCUMENTS

| | | | | |
|---|---|---|---|---|
| 4,828,240 | A * | 5/1989 | Longenecker et al. | 269/47 |
| 4,874,639 | A | 10/1989 | Matsui et al. | |
| 6,113,088 | A * | 9/2000 | Gakhar et al. | 269/139 |
| 6,367,788 | B1 * | 4/2002 | Babchuk | 269/45 |
| 6,702,269 | B1 * | 3/2004 | Tadich | 269/37 |
| 6,899,324 | B2 * | 5/2005 | Fredrickson et al. | 269/37 |
| 7,635,119 | B1 * | 12/2009 | Patel | 269/73 |
| 7,900,898 | B2 * | 3/2011 | Wampler, II | 269/152 |
| 2009/0269170 | A1 * | 10/2009 | Bradsher | 414/147 |

* cited by examiner

*Primary Examiner* — Lee D Wilson

(57) ABSTRACT

A panels-off painting process and system adapted for use with a plurality of workpieces includes a carrier having a main platform, stationary support structures, and at least one rotatable assembly interconnected to the platform, configured so as to be caused to shift at least a portion of the workpieces between first and second orientations, and including a counterbalance that reduces the force necessary to cause the shift, and preferably further includes a retrofitted robotic arm programmably configured to apply a coat to the workpieces and subsequently engage the assembly so as to cause the shift.

13 Claims, 5 Drawing Sheets

PANELS-OFF COATING PROCESS AND CARRIER UTILIZING PANEL ROTATION

BACKGROUND OF THE INVENTION

1. Field of the Invention

The present invention relates to panels-off coating processes and paint carriers adapted for use during the same, and more particularly, to an improved panels-off coating process utilizing selective rotation of individual workpieces prior to curing, and a modified carrier configured to facilitate rotation.

2. Discussion of Prior Art

Consumers have long attributed high significance to appearance when considering the purchase of products. In the automotive industry, for example, appearance with respect to paint application plays an important role in determining which vehicles are afforded preference. Specialized paint and painting processes have been developed to reduce the likelihood and affects of undesirable conditions, such as orange peeling (i.e., a paint film having an uneven texture like that of an orange) and more commonly sagging (i.e., downward dropping of the paint film caused by gravity), as shown in prior art FIG. 1.

Other aspects of manufacturing, however, must be balanced with quality of appearance in order to maintain a reasonable cost per product. For example, efficiency of construction and rapid turn around are also desired automotive goals. To that end, panels-off processing, which enables parallel processing of the frame and exterior panels of a vehicle, have been developed to supplant traditional series painting processes that treat the swing metal attached to the body in car position. In a panels-off painting process, a modified carrier is configured to convey and support only the panels during painting and curing periods. At least a portion of the panels are typically oriented vertically to reduce the lateral width of the carrier, and thereby facilitate travel through increasingly crowded workstations. Concernedly, however, this space saving measure increases the likelihood of gravitational sagging, thereby creating a paradox between reducing the travel space required by the carrier and improving the appearance of the paint application.

SUMMARY OF THE INVENTION

The present invention concerns a panels-off painting process and modified carrier that address this paradox. That is to say, among other things, the invention is useful for reducing the travel space required by the carrier without increasing the likelihood of gravitational sagging in the paint application. The invention accomplishes this duality by rotating vertically oriented workpieces after transport and painting, so that they cure in horizontal orientations.

In comparison to the prior art, products coated by the inventive process have been observed to exhibit at least a thirty-percent reduction rate in incidents of orange-peeling and significantly reduced rates of sagging. The result is a significantly improved quality of appearance with respect to the paint application, and more preferential treatment for the products. Finally, the invention is adapted for incorporation by existing panels-off systems with minimal modification, so as to facilitate implementation.

A first aspect of the present invention concerns a method of transporting a plurality of workpieces, painting at least one target surface defined by each workpiece, and minimizing sag during painting. The method includes the step of securing the workpieces in a first orientation at a first location having an ambient temperature and humidity. In the first orientation, at least a portion of the workpieces present non-horizontal target surfaces to facilitate travel. A paint is applied to each of the target surfaces so as to form a coating having a first thickness thereupon. The method further includes rotating within a first period each of said at least portion of the workpieces to a second orientation and securing said at least portion of the workpieces in the second orientation. In the second orientation, the target surface of said each of said at least portion of the workpieces becomes generally horizontal. Finally, the coatings are cured, when each of the target surfaces are generally horizontal.

A second aspect of the present invention concerns a transport carrier adapted for use with a plurality of workpieces, and during sequential transport, painting and curing processes. The carrier comprises a main platform configured to support the workpieces during the processes, and at least one rotatable assembly fixedly connected to a portion of the workpieces. The assembly is pivotally connected to the platform, and configured to retain the portion of the workpieces in a first orientation relative to the platform during the transport and painting processes. The assembly is further configured so as to cause to rotate said at least portion of the workpieces to a second orientation relative to the platform, and to fixedly retain said at least portion in the second orientation during the curing process.

Other aspects and advantages of the present invention, including the further addition of a retrofitted robotic arm programmably configured to engage the carrier, so as to autonomously perform the afore-mentioned method, will be apparent from the following detailed description of the preferred embodiment(s) and the accompanying drawing figures.

BRIEF DESCRIPTION OF THE DRAWING FIGURES

A preferred embodiment of the invention is described in detail below with reference to the attached drawing figures, wherein:

FIG. 1 is a front and side elevation view of a workpiece and prior art paint application, wherein sagging has occurred;

FIG. 1*a* is a front and side elevation view of a workpiece and paint application performed in accordance with a preferred embodiment of the invention;

Figure 6:
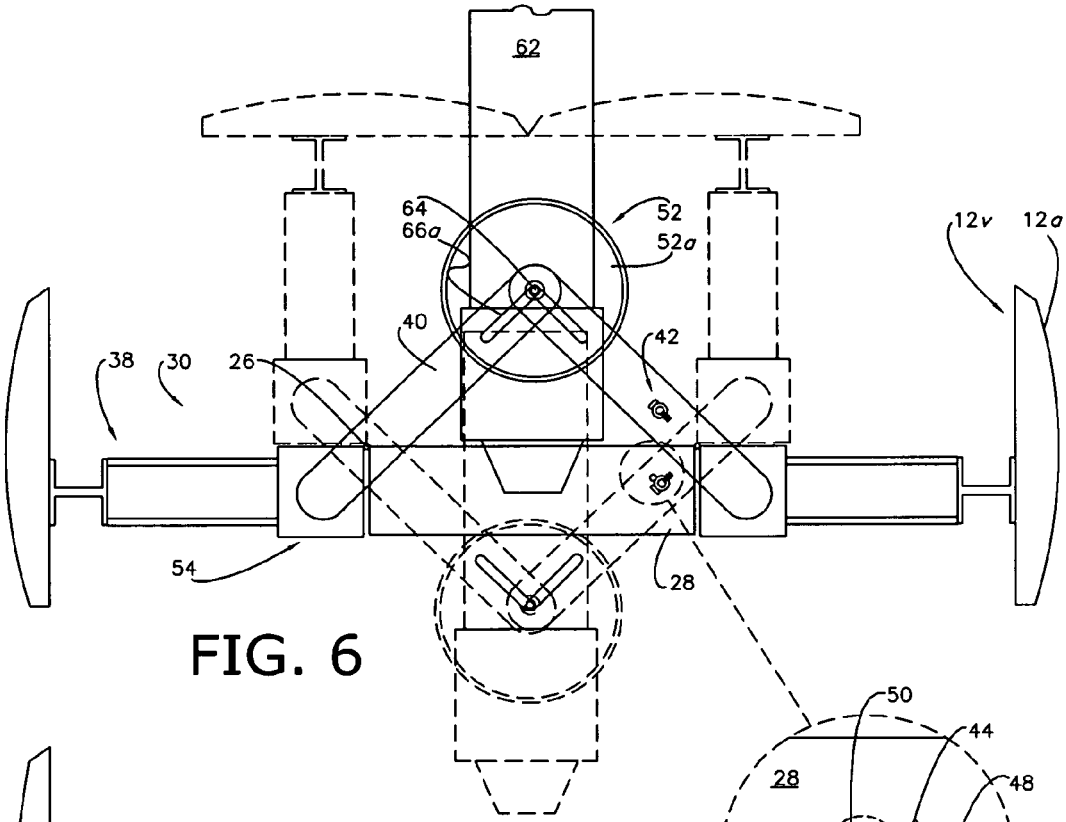
Figure 7:
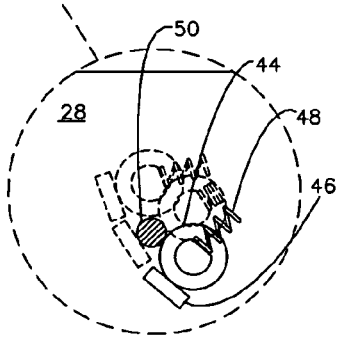
Figure 7:
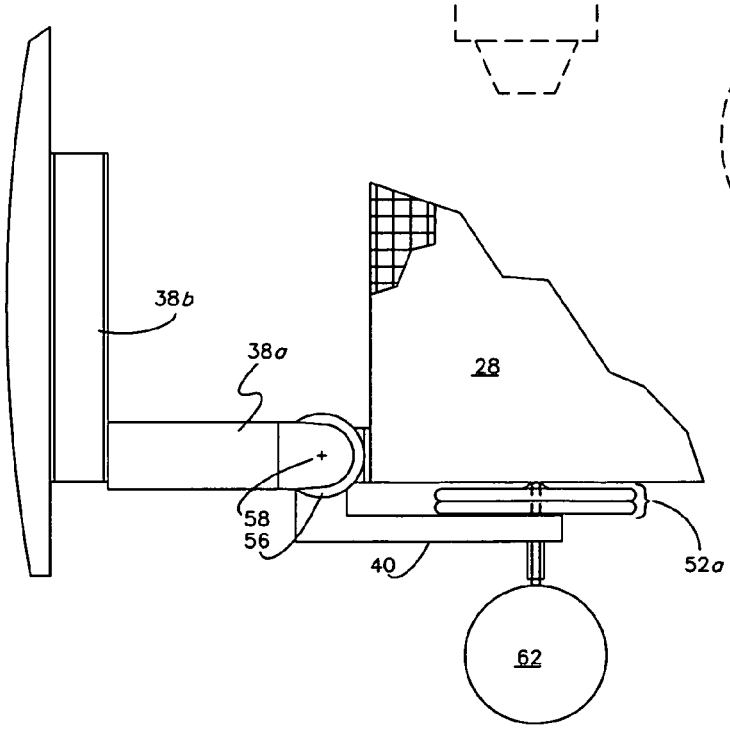
Figure 6A:
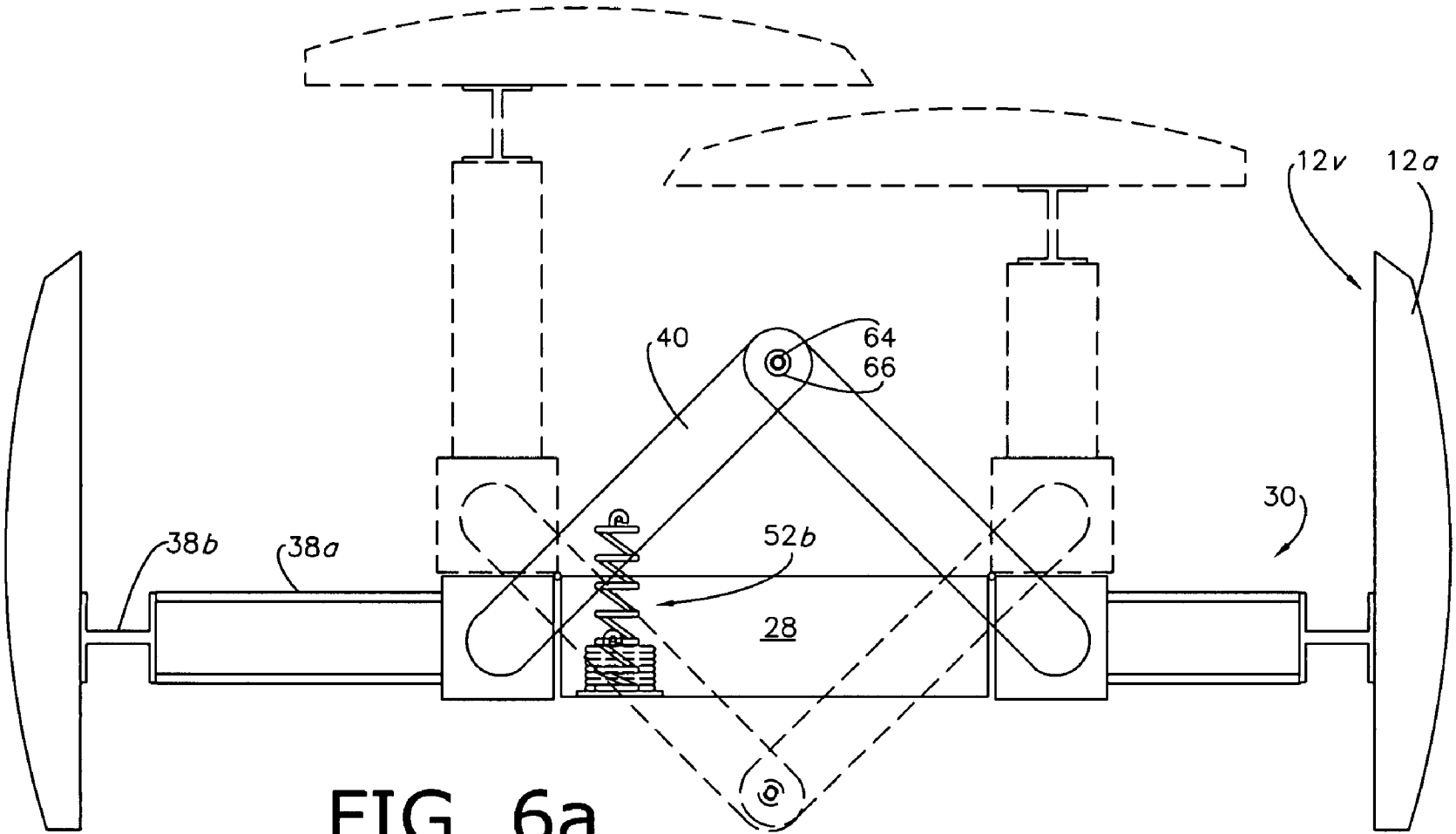

FIG. 6 is a partial rear elevation view of a carrier, particularly illustrating a lateral pair of rotatable assemblies attached to individual workpieces, a free body mass counter-balance, a latching mechanism, and a retrofitted robotic arm engaging the assemblies in first non-rotated (solid line) and second rotated (hidden line) conditions, in accordance with a preferred embodiment of the invention;

FIG. 6*a* is a partial rear elevation view of a carrier as shown in FIG. 6, wherein the counter-balance is a spring element, and the assemblies present dissimilar bracket lengths that result in a stacked workpiece configuration when rotated; and FIG. 7 is a schematic plan view of a portion of the platform, an assembly, and the robotic arm shown in FIG. 6.

DESCRIPTION OF THE PREFERRED EMBODIMENT

Figure 2:
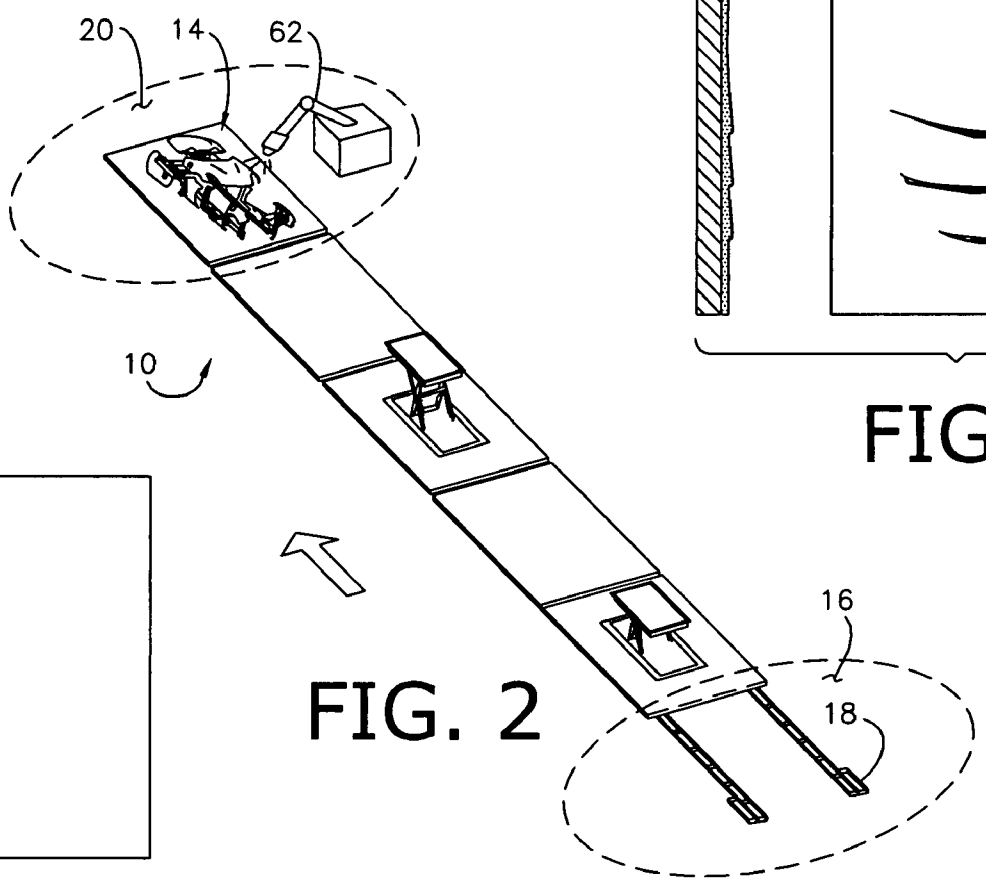
FIG. 2 is a perspective schematic view of an assembly line comprising a plurality of skillets, a skillet-borne carrier, and a drive mechanism transporting the carrier from a first and to a second area.
Figure 3:
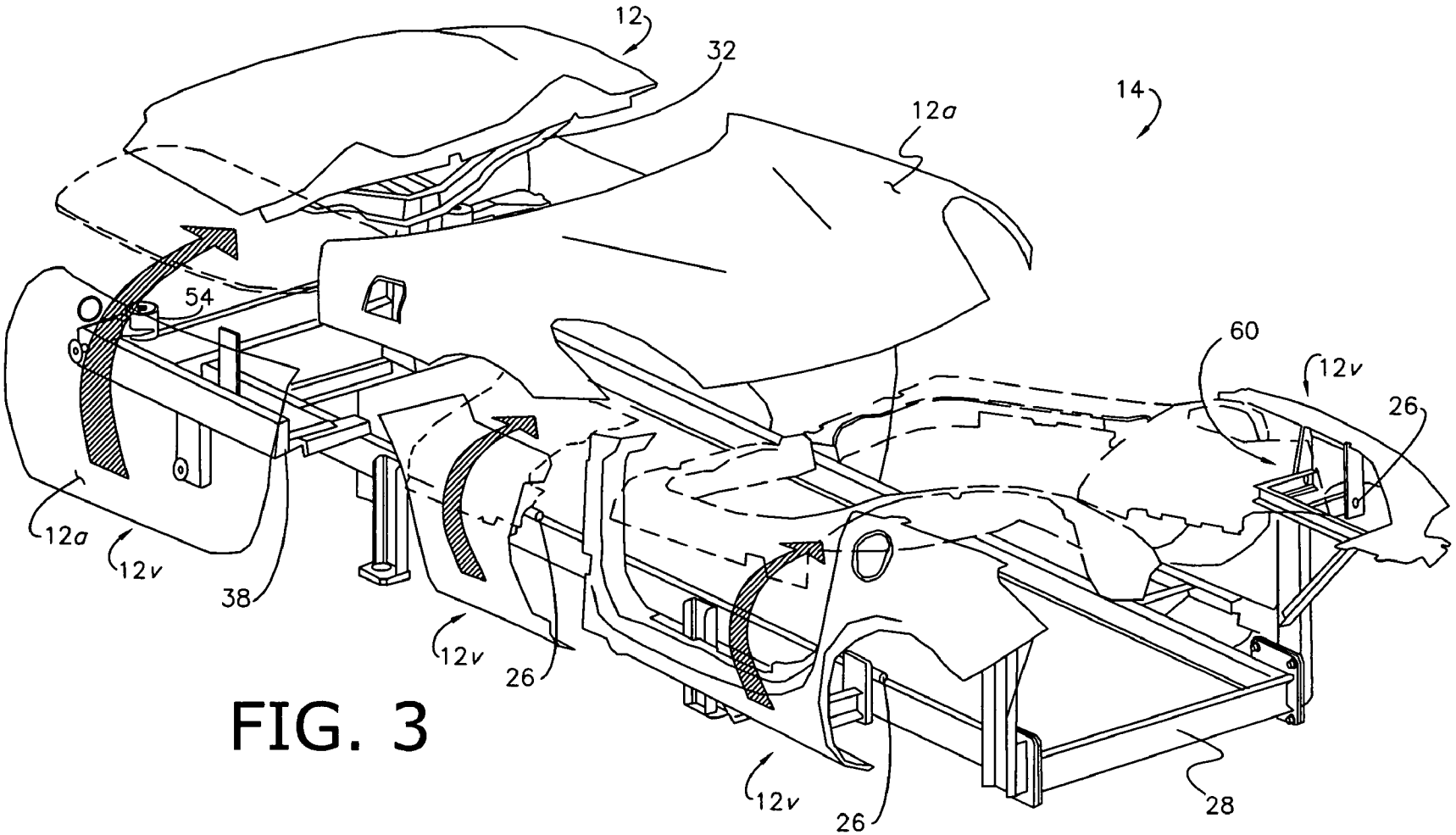
FIG. 3 is a perspective view of a stationary carrier supporting a plurality of workpieces, in accordance with a preferred embodiment of the invention, particularly illustrating a portion of the workpieces being rotated between first vertical and second horizontal orientations.

Referring to FIGS. 2-7, the present invention concerns a system 10 and method of painting a plurality of workpieces 12. More preferably, the system 10 is adapted for use with a plurality of generally planar workpieces (or "panels"), such as the various external panels of an automotive vehicle (FIG. 3). The system 10 includes a novel paint carrier 14 that is configured to enable rotation of at least a portion (i.e., one or more) of the workpieces 12. As a result, it is appreciated that panels 12 that were normally baked (i.e., cured under elevated temperatures) vertically are able to rotate to a horizontal position, which significantly improves quality of appearance. As best shown in FIGS. 2 and 3, the carrier 14 is configured to facilitate transport through crowded environments, and as such initially retains the portion of the workpieces in a non-horizontal and more preferably, a generally vertical (e.g., presenting an angular measurement of 90°65° with horizontal) orientation prior to painting.

Figure 1:
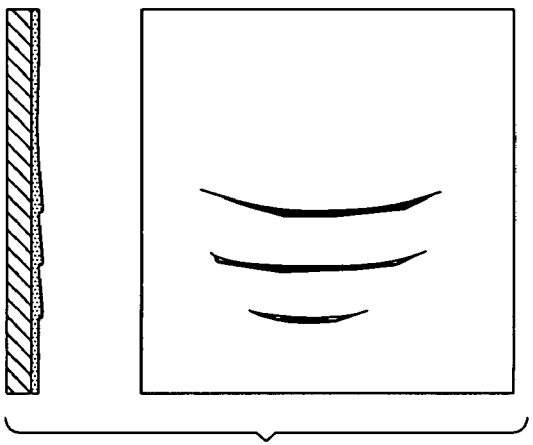
Figure 1A:
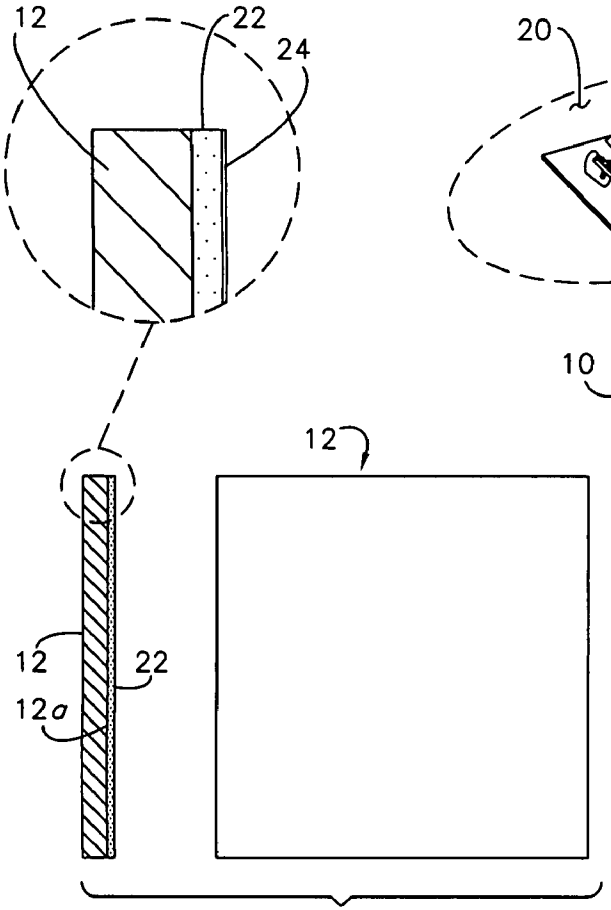

The inventive method is preferably performed automatically and is transparent to existing paint processes (i.e., existing pathworks need not be modified) thereby resulting in facile implementation. The method preferably presents a panels-off painting process, wherein the panels are held by the carrier 14 instead of being incorporated into the body of the vehicle, so that the frame (not shown) does not have to be transported by the carrier 14 and subjected to the painting process. The method includes transporting a plurality of workpieces, painting at least one target surface 12*a* defined by each workpiece, and manipulating at least a portion of the workpieces so as to minimize sagging during curing. FIGS. 1 and 1*a* exemplarily compares a prior art paint application exhibiting sagging and the results of a paint application performed under the present invention.

More particularly, the method begins by securing the workpieces 12 in a first orientation at a first location 16 having an ambient temperature and humidity, such as the loading dock of an assembly line. As previously mentioned, at least a portion of the workpieces in this location present non-horizontal target surfaces 12*a* (e.g. the major exterior surface of a vehicle panel), so as to reduce the travel space required by the carrier 14. In FIG. 3, for example, the quarter panels, doors, and fenders are shown in an initially vertical orientation; while the hoods, decks, and roof are horizontally oriented.

In a preferred embodiment of the invention, once the workpieces 12 are securely affixed thereto, the carrier 14 is caused to be transported by a drive mechanism (e.g., "drive") 18 to a second location 20 where the application of a coating is performed under controlled temperature and humidy. For example, the second location 20 may be a painting station wherein a paint or otherwise lamination is applied to each of the target surfaces 12*a*, so as to form a coat 22 having a first thickness thereupon (FIG. 1). The coat 22 is applied to all workpieces 12, including the portion of the workpieces 12 in the vertical orientation, as it is appreciated that once rotated the vertically oriented target surfaces 12*a* may become inaccessible. One of a plurality of conventional drives 16 may be utilized by the present invention to effect translation of the carrier 14, as is well known in the art. For example, the carrier 14 may be borne by a skillet conveyer system, as shown in FIG. 2, or pushed by a conveyor chain.

After the coat 22 is applied to the workpieces 12, the vertically oriented workpieces 12*v* are rotated within a first period configured to prevent orange peeling, sagging or other surface defects influenced by gravity from manifesting. It is appreciated by those of ordinary skill in the art that the period is directly related to the constituency and thickness of the coat 22, and more particularly, to the physical properties exhibited thereby, such as viscosity. For example, where the coat 22 consists essentially of a 2.0 mils (0.054 mm) thick layer of a two-component isocyanate mixture, the vertical workpieces 12*v* are preferably rotated within 120 seconds and more preferably within 10 seconds of the application. Preferably, each of the vertical workpieces 12*v* are rotated to a second orientation (presented by hidden line in FIG. 3), wherein the target surface 12*a* is generally horizontal, and then secured in the second orientation. Where the workpiece 12*v* presents a plurality of non-parallel target surfaces 12*a*, it is appreciated that the degree of rotation may be modified to facilitate curing along each surface 12*a*. For example, for a workpiece 12*v* having first and second generally orthogonal surfaces 12*a*, the workpiece 12*v* is preferably rotated to a second orientation, wherein the larger (or more visible) of said surfaces presents a 30° angle with horizontal.

After rotating the vertical workpieces 12*v*, the coat 22 is allowed to cure by undergoing a curing process. The process is preferably configured to facilitate and accelerate curing. For example, where the coat 22 consists of a dual polymer-based paint, the process preferably includes baking the coat 22 at a temperature greater than the minimum cross-link temperature, so as to cause the polymers to cross link, thereby producing strong bonds and a hard film exterior 24 (FIG. 1*a*). It is appreciated that polymer-based paints reach their lowest viscosity just before reaching their cross-link temperature, which further highlights the benefits of rotating the vertical workpieces 12*v* under the present invention.

In a preferred embodiment, the second location 20 may be cooperatively equipped to both paint and bake the workpieces 12; or in another embodiment, the carrier 14 may be caused to be transferred to a third location (not shown) operable to bake the workpieces 12, such as a conventional oven having an ambient temperature greater and a humidity less than that of the characteristic temperature (e.g., the minimum polymer cross-link temperature). Finally, the workpieces 12 are baked for a predetermined duration (e.g., 20 minutes at set temperature), so as to achieve optimal cross-linking, as is known in the art. It is appreciated that the first and second locations 16, 20 may coincide, where the workpieces are secured to the carrier and painted at a single location prior to transport; or that the first, second and third locations 16, 20 may coincide, wherein the workpieces 12 are secured, painted and cured at a single location. In the later configuration, the carrier 14 may be stationary (FIG. 3).

Turning to the structural configuration of the invention, the carrier 14 is adapted for fixedly securing and supporting the workpieces 12 and performing the rotational steps of the afore-described method. More preferably, the present invention can be performed by retrofitting an existing paint carrier, so as to facilitate implementation. That is to say, an existing carrier may be modified for use in the present invention, by determining proper hinging locations about which the vertical workpieces 12*v* are rotated, spans for engaging the rotated workpieces, and clearance modifications for enabling rotation based on the spans. Hinging mechanisms (i.e., hinges) 26 suitable for carrying anticipatory loads and providing horizontal axes of rotation, panel tie-ins for removably securing the vertical workpieces 12*v*, and counter-balancing for reducing the force needed to rotate the vertical workpieces 12*v* are preferably added, as further discussed herein.

Figure 4:
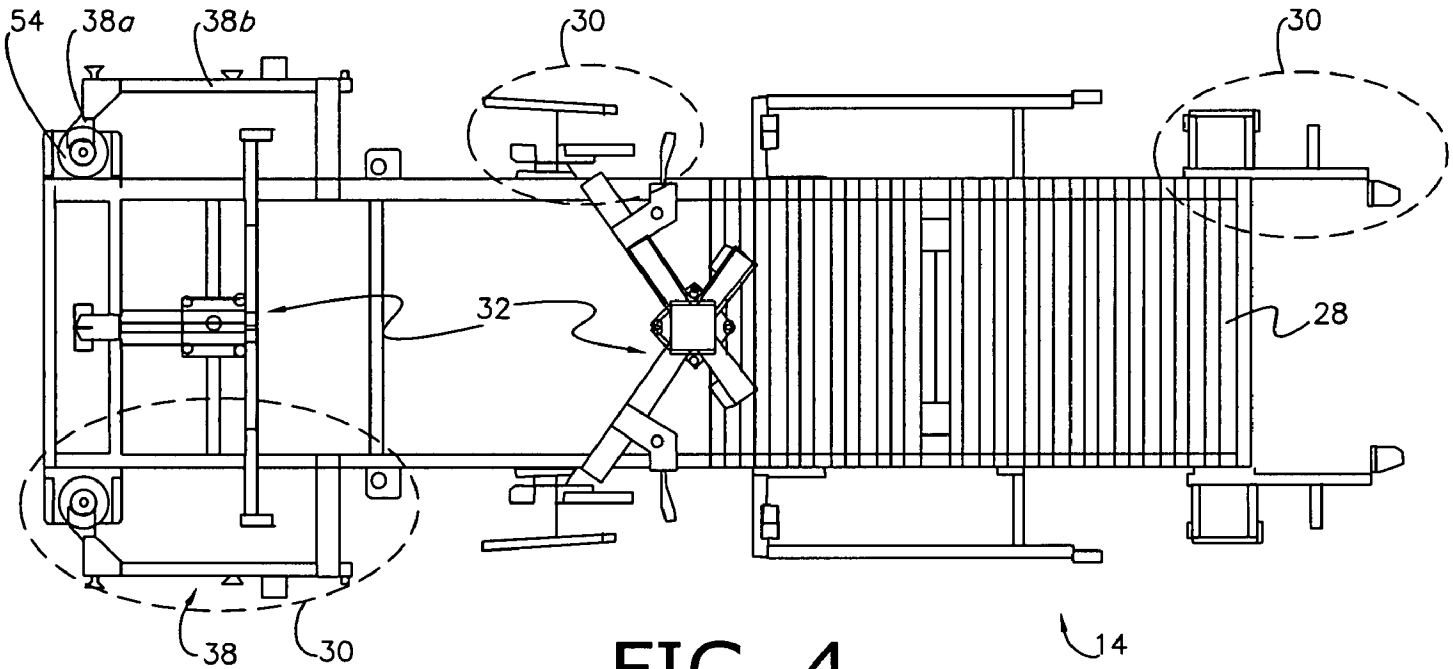
FIG. 4 is a plan view of a carrier, particularly illustrating a mesh platform, rotatable assemblies including rear coffee-can pivot joints, and workpiece support structures, in accordance with a preferred embodiment of the invention.

The carrier 14 includes a main structural platform 28, such as the planar rectangular lattice shown in FIG. 4, and at least one rotatable assembly 30 for fixedly connecting to the vertical workpieces 12*v* and rotatably connected via the hinging mechanism 26 to the platform 28. As previously mentioned, an existing carrier platform may be retrofitted for use in the present invention by welding the novel rotatable assembly 30 thereto; more preferably, however, so as to further reduce the later width of the carrier 14, a notch configured to receive the assembly 30 is first removed from the platform 28. The preferred platform 28 is further configured so as to be directly connectable to a portion of the workpieces 12, and to retain these workpieces in a stationary orientation wherein the target surface 12*a* is generally horizontal.

Figure 5:
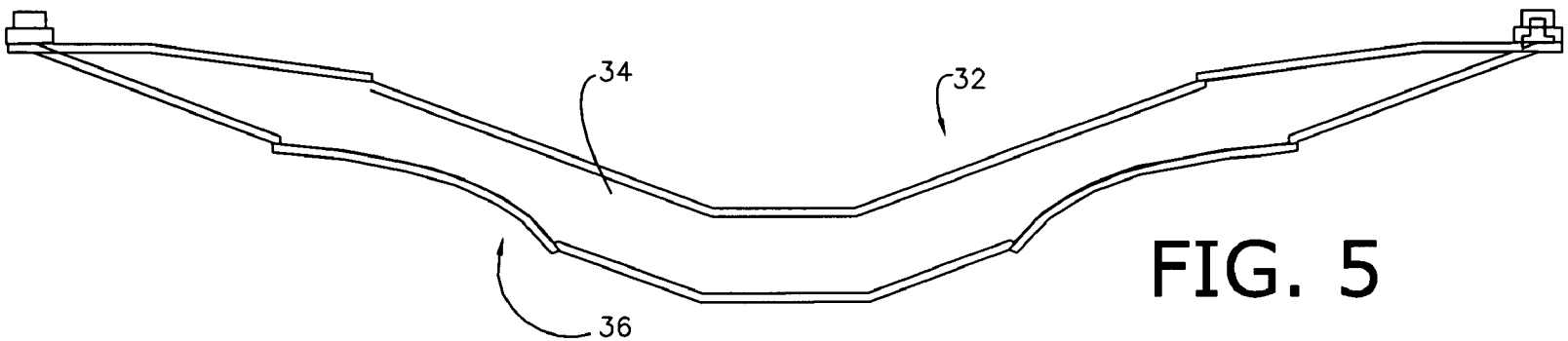
FIG. 5 is an enlarged elevation view of a rear hood support structure modified to accommodate workpiece rotation, in accordance with a preferred embodiment of the invention.

As previously described in the automotive setting, for example, the platform 28 is preferably configured to retain the hoods, decks and/or roof in generally horizontal orientations. To facilitate this, at least one elevated stationary structure (i.e., support) 32 is preferably attached and configured to enable better use of the three-dimensional space above the platform 28. For example, as best shown in FIG. 5, the supports 32 may present diagonally ascending wings 34 defining a top surface spaced from the platform 28, and bottom radial cut-outs 36 (FIG. 5) configured to facilitate the rotation of the workpieces 12*v*. It is appreciated that the cut-outs 36 must be minimally configured so as not to compromise the structural integrity of the support 32.

More preferably, each assembly 30 is configured to retain a separate vertical workpiece 12*v* in a fixed condition relative to the platform 28, and as such also presents a support structure. The assembly components, including the respective hinge 26, are sized to sustain the anticipatory load (e.g., workpiece weight plus the counter-balance force). For example, an industrial strength steel butt hinge of sufficient gauge and length is preferably welded to the platform 28. The assembly 30 is configured relative to the platform 28 and support 32, so as to be caused to rotate the vertical workpieces 12*v* to a generally horizontal (e.g., presenting an angular measurement of 0°65° with horizontal) orientation, and as such a minimum of 90° of swing-ability is preferred.

As shown in FIGS. 3-7, the preferred assembly 30 more particularly includes a structural bracket 38 fixedly connectable to at least one vertical workpiece 12*v* and appositely to the hinge 26. In a preferred embodiment, the preferred bracket 38 presents a 90° bent elbow consisting of an extender portion 38*a* emanating from the hinge 26 and a workpiece engaging portion 38*b* preferably configured to laterally co-extend with the particular workpiece. Exemplarily, the workpiece 12*v* and engaging portion 28*b* may define pluralities of alignable holes cooperatively configured to receive at least one tie-in fastener (not shown). Alternatively, the engaging portion 38*b* may be configured so as to be slidably coupled to or magnetically engaged with at least a portion of the workpiece 12*v*.

In the illustrated embodiment, the assembly 30 further includes a swing arm 40 (FIGS. 6-7). The arm 40 is fixedly connected to the bracket 38 and presents a distal portion opposite the engaging portion 38*b* relative to the horizontal axis of rotation. The arm 40 preferably extends at a 45° angle from the bracket 38. The arm 40 presents a structure member sufficient to withstand the anticipatory applied rotation force. Finally, in manual rotations, the preferred arm 40 further includes a handle (not shown) located at or near the distal end to maximize the mechanical advantage afforded the user.

Once rotated thereto, the assembly 30 is configured to fixedly retain the workpieces 12*v* in the second orientation during the curing process. For example, the degree of freedom may define a fulcrum, such that the weight of the workpiece 12*v* functions to secure it in the second orientation. Alternatively, the assembly 30 may include a latching mechanism 42 configured to engage the platform 28 when the workpieces 12*v* is in the second orientation. As shown in FIG. 6, a spring biased mechanism 42, including a bearing 44, stop 46, spring 48 and engaging pin 50 attached to the platform 28 may be utilized. The bearing 44 is configured to engage the pin 46 as the swing arm 40 rotates. The pin 50 pushes the bearing 44 against the spring 48 as it passes intermediate the bearing 44 and stop 46.

The assembly 30 is preferably configured to counter-balance the weight of the attached workpiece 12*v*, so as to produce a counter force that reduces the force necessary to rotate the workpiece 12*v*. As such, a counter-balancing element 52 is drivenly coupled to the bracket 38 and configured to work oppositely to the weight of the workpiece 12*v*. For example, as shown in FIG. 6, the element 52 may essentially consists of a free-body mass 52*a* of known weight, or a plurality of removably coupled masses 52*a* (FIG. 7) presenting a predetermined total weight, wherein the later is preferred so as to add adjustability. Alternatively, or in addition to the mass 52*a*, the element 52 may consist of a spring 52*b* under constant tension while the respective workpiece 12*v* is in the vertical orientation (FIG. 6*a*). Where the centroid of the workpiece 12*v* is spaced from the horizontal axis a workpiece distance, it is appreciated that the element 52 may be coupled to the assembly 30, such that the counter force is produced at a counter distance greater than the workpiece distance, which enables the counter force to be reduced.

The weight of the workpiece 12*v* produces a first moment acting about the horizontal axis in a first direction (i.e., either clockwise or counter-clockwise), while the element 52 is configured to generate a counter force and produce a second moment acting about the axis in a second direction opposite the first. This results in a net moment acting about the axis in the first direction equal to the first moment minus the second. The workpiece 12*v* and bracket 38 are rotatable by applying a vertical force that results in an applied moment about the axis in the first direction greater than the net moment. For example, where the workpiece 12*v* presents a vehicle door weighing 60 lbs (i.e., 267 N), the counter-balance element 52 preferably produces a counter force of 50 lbs (i.e., 222 N), so that the assembly 30 is caused to rotate when a vertical force greater than 10 lbs (i.e., 44 N) is applied thereto.

Finally, where counter-balancing is provided, it is appreciated that a selectively engageable second latching mechanism (or manual lock) is preferably included and configured to hold the assembly 30 in the first orientation when a workpiece 12*v* is not attached to the bracket 38. That is to say, the second mechanism results in a holding force sufficient to counter the counter-balance moment about the axis, so that the assembly 30 does not rotate, when engaged. An initial force sufficient to further overcome the second latch is therefore produced during rotation; or where a manual lock is utilized, an operator may be charged with the task of engaging the lock prior to removing the cured workpiece 12*v* and disengaging the lock after placement of a new workpiece 12*v*.

At least a portion of the assemblies 30 preferably define vertical axes of rotation, so as to enable the respective workpiece 12*v* to swivel during the painting process an angle not less than 20, more preferably not less than 40, and most preferably not less than 60 degrees. In this regard, the assembly 30 preferably includes a roller joint (or "coffee can") 54 intermediately coupled to the hinge 26 and extender portion 38*a* of the bracket 38. As is known in the art, the joint 54 includes sleeve 56 and roller 58 inserted therein. The roller 58 may be integrally formed with the extender portion 38*a*, as shown in FIG. 7. Finally, a lubricant layer (not shown) is preferably intermediately disposed between the engaging surfaces of the sleeve 56 and roller 58, as is preferable throughout the engaging surfaces of the carrier 14.

In the illustrated embodiment, a plurality of assemblies 30 are pivotally connected to the platform 28 and symmetrically positioned. The assemblies 30 may be identical or present variable configurations or dimensioning as necessary. For example, for a pair of longitudinally congruent and laterally spaced assemblies 30 (FIG. 6), the assemblies may be variably configured so that their respective workpieces 12*v* present a vertically stacked configuration when in the second orientation. In FIG. 6*a*, the bracket extender 38*a* of a first of the pair of assemblies 30 is shorter than that of the other, resulting in a stacked configuration and the ability to treat larger workpieces 12. Alternatively, a pair of laterally spaced assemblies may present off-set axes of rotation to effect the stacked configuration. The longitudinally spaced pairs of assemblies 30 may also present an offset in axes of rotation to accommodate differing workpiece 12*v* dimensions.

In FIG. 3, a plurality of assembly configurations is presented. The front door panels to the rear of the carrier 14 are supported by an afore-described coffee-can assembly configuration. The rear quarter panels towards the front of the carrier 14 are supported by an assembly comprising a lever arm 60; and the side panels in the middle are supported by shorter span assemblies (not shown).

A suitable material for forming the various structural members of the carrier 14, including the bracket 38 and platform 28, is steel. Where the workpieces 12 are formed of plastic or non-metallic material and not bolted to the carrier 14, it is appreciated that provisions (not shown) for sufficiently grounding the workpieces are also necessarily incorporated into the carrier 14 to enable electrostatic applications of clear-coat, for example. With further regard to clear-coat application, it is also appreciated that the present invention enables a thicker layer to be applied, which results in a significant increase in quality of appearance, as conventional concerns and limitations due to gravitational sagging will be addressed.

In another aspect of the invention, the system 10 further includes a programmable machine 62 configured to autonomously cause the vertical workpieces 12*v* to shift between the first and second orientations. The preferred machine 62 is detached and spaced from the carrier 14, located at the second location 20 (FIG. 2), and configured to selectively engage the assembly 30 to impart the required rotational force thereto. For example, as best shown in FIGS. 6 and 7, the machine 62 may present a retrofitted robotic paint arm. More particularly, a conventional robotic paint arm may be programmably configured to apply the paint coat 22 to the workpieces 12, and retrofitted to engage the assembly 30 only after applying the coat 22.

As shown in FIGS. 6-7, retrofitting may include fixedly attaching (e.g., welding, bonding, coupling, etc.) a solid pin 64 to the robotic paint arm 62 and including a sleeve 66 configured so as to tightly receive the pin 64 within the assembly 30. More preferably, and as shown in FIG. 7, a horizontal sleeve 66 may be presented by swing arm 40 at or near its distal end, such that the pin 64 enters the sleeve 66 by autonomously causing the paint arm 62 to laterally translate to a predetermined position. Alternatively, the sleeve 66 may be incorporated into the body of the swing arm 40 so as to simply present an opening 66*a* configured to receive the pin 64 instead of a protruding structure. In another alternative, the arm 46 may conversely present the sleeve 66 and the pin 64 may be attached to the assembly 30.

After inserting the pin 64 within the sleeve 66, the paint arm 62 then translates so as to apply a vertical force to the pin 64 and sleeve 66. For example, the arm 62 may be configured to apply the translation force in a downward direction, which causes the workpieces 12*v* to rotate in the upward direction. In this configuration, the swing arm 40 preferably defines a slot opening 66*a* for receiving the pin 64, so that a purely (i.e., vertically) downward force can be applied to lifting the load. This reduces the stresses on the pin 64 during lowering and lifting the workpiece 12*v*. It is appreciated that counter-balancing also enables the force transmitted through the pin 64 and sleeve 66 and borne by the otherwise conventional robotic arm 62 to be reduced.

Finally, it is also within the ambit of the invention to link laterally spaced assemblies 30 so as to effect uniform motion upon the application of a single vertical force. As shown in FIG. 6, for example, the swing arms 40 of oppositely presented assemblies 30 may be cooperatively configured such that the openings 66*a* defined by each are adjacently aligned in the first orientation and able to be concurrently engaged by the pin 64 when aligned.

The preferred forms of the invention described above are to be used as illustration only, and should not be utilized in a limiting sense in interpreting the scope of the present invention. Obvious modifications to the exemplary embodiments and modes of operation, as set forth herein, could be readily made by those skilled in the art without departing from the spirit of the present invention. The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A transport carrier adapted for use with a plurality of workpieces, and during sequential transport, painting and curing processes, said carrier comprising:

a main platform configured to support the workpieces during the processes; and at least one rotatable assembly having at least one arm extending outward from the platform fixedly connectable to at least a portion of the workpieces, the arm configured to hold a weight of the portion of the workpieces as the portion of the workpieces are spaced from the platform, the assembly including a hinge pivotally connected to the platform, and the assembly configured to retain said at least portion of the workpieces in a first orientation relative to the platform during the transport and painting processes, said assembly being further configured so that the arm is rotatable about the hinge to rotate said at least portion of the workpieces to a second orientation relative to the platform while the workpiece remains fixed to the arm and the weight of the workpiece is supported by the arm, and to fixedly retain said at least portion in the second orientation during the curing process.

2. The carrier as claimed in claim 1, wherein the platform presents a planar configuration defining four corners, and each of a plurality of four assemblies is pivotally connected to the platform at a respective corner.

3. The carrier as claimed in claim 1, wherein the assembly further includes a latching mechanism configured to engage the platform, when said at least portion is in the second orientation, the latching mechanism configured to hold the rotatable assembly and workpiece in the second orientation.

4. The carrier as claimed in claim 1, wherein the platform is directly connected to a stationary portion of the workpieces, and configured to retain each of said stationary portion of workpieces in a stationary orientation, wherein the target surface is generally horizontal.

5. The carrier as claimed in claim 4, wherein the platform and assembly are cooperatively configured so as to vertically stack the workpieces, when said at least portion of the workpieces are in the second orientation.

6. The carrier as claimed in claim 1, wherein the assembly includes a bracket fixedly connectable to said at least portion of the workpieces, defines a horizontal axis of rotation, and is configured to vertically rotate the bracket about the horizontal axis while supporting the weight of the workpiece fixedly connected to the assembly.

7. The carrier as claimed in claim 6, wherein the assembly further defines a vertical axis of rotation, and is configured to rotate the bracket about the vertical axis.

8. The carrier as claimed in claim 6, wherein said at least portion of the workpieces present the weight supported by the rotatable assembly, the weight produces a first moment acting about the horizontal axis in a first direction, the assembly includes a counter balancing element configured to generate a counter force and produce a second moment acting about the axis in a second direction opposite the first, so as to result in a net moment acting about the axis in the first direction equal to the first moment minus the second, and the bracket is rotatable by applying an upward force resulting in an applied moment about the axis in the first direction greater than the net moment.

9. The carrier as claimed in claim 8, wherein the counter balancing element includes at least one uniform body having a predetermined weight.

10. The carrier as claimed in claim 8, wherein the counter balancing element includes a spring configured to bias the assembly toward the first orientation.

11. The carrier as claimed in claim 8, wherein the element is adjustably configured, so as to modify the counter force generated.

12. A system adapted for use with a plurality of workpieces and during a painting process, said system comprising:

a transport carrier including a main platform configured to support the workpieces during the process, and at least one assembly interconnecting the platform and at least a portion of the workpieces, and modifiable so as to cause said at least portion of the workpieces to shift between first and second orientations relative to the platform, when connected to the workpieces;

a drive mechanism configured to transport the platform, said at least one assembly, and workpieces between first and second locations; and a programmable machine configured to engage the assembly, so as to cause said at least portion to shift from the first and to the second orientation, wherein the machine is a retrofitted robotic arm presenting one of a sleeve and pin insertably receivable by the sleeve, the assembly presents the other of said sleeve and pin, and the arm engages the assembly by causing the pin to be inserted into the sleeve and applying a force to the pin and sleeve.

13. The system as claimed in claim 12, wherein the machine is programmably configured to apply a coat to the workpieces, and engage the assembly after applying the coat.

* * * * *